United States Patent [19]

Dowzall et al.

[11] Patent Number: 4,513,511

[45] Date of Patent: Apr. 30, 1985

[54] LAYOUT BOARDS

[75] Inventors: Martin E. Dowzall, Wyckoff; Vazgen J. Houssian, Union City, both of N.J.

[73] Assignee: Esselte Pendaflex Corporation, Garden City, N.Y.

[21] Appl. No.: 407,581

[22] Filed: Aug. 12, 1982

[30] Foreign Application Priority Data

Aug. 14, 1981 [GB] United Kingdom ..... 8124883

[51] Int. Cl.[3] ..... B43L 13/24

[52] U.S. Cl. ..... 33/447; 33/430

[58] Field of Search ..... 33/1 G, 14 A, 403, 430, 33/443, 438, 447, 184.5, 180 R, 445; 248/455

[56] References Cited

U.S. PATENT DOCUMENTS

| | | | |
|---|---|---|---|
| 1,351,534 | 8/1920 | Perdue et al. | 33/445 X |
| 1,801,197 | 4/1931 | Halvorsen et al. | 33/430 X |
| 2,822,736 | 2/1958 | Padgett | 33/184.5 X |
| 3,400,461 | 9/1968 | Faul | 33/438 |
| 3,620,362 | 11/1971 | Valdex | 248/455 X |
| 3,746,992 | 7/1973 | Serembe | 33/DIG. 1 X |
| 4,138,818 | 2/1979 | Hebel | 33/DIG. 1 |
| 4,232,452 | 11/1980 | Dowzall et al. | 33/430 |
| 4,342,155 | 8/1982 | Waldron | 33/184.5 |
| 4,364,184 | 12/1982 | Dowzall | 33/447 |

FOREIGN PATENT DOCUMENTS

| | | | |
|---|---|---|---|
| 2924268 | 12/1980 | Fed. Rep. of Germany | 33/403 |
| 750944 | 6/1956 | United Kingdom | 33/430 |

*Primary Examiner*—Harry N. Haroian

*Attorney, Agent, or Firm*—Darby & Darby

[57] ABSTRACT

A drawing board for use with dry transfer materials is described. The board has a track along one edge and a paper clamp along an adjacent edge. The track bears a bar parallel to the paper clamp which in turn bears a carriage to which a dry transfer sheet can be affixed. The carriage may be racked up and down to bring an appropriate line of dry transfer letters over an appropriate place on a piece of paper held in the paper clamp. The carriage may be provided with a mechanism for holding it firm and then moving the dry transfer sheet clamp slightly. This mechanism enables words to be built up and which the letters are evenly spaced easily and quickly.

7 Claims, 3 Drawing Figures

Figures 1, 2, 3:
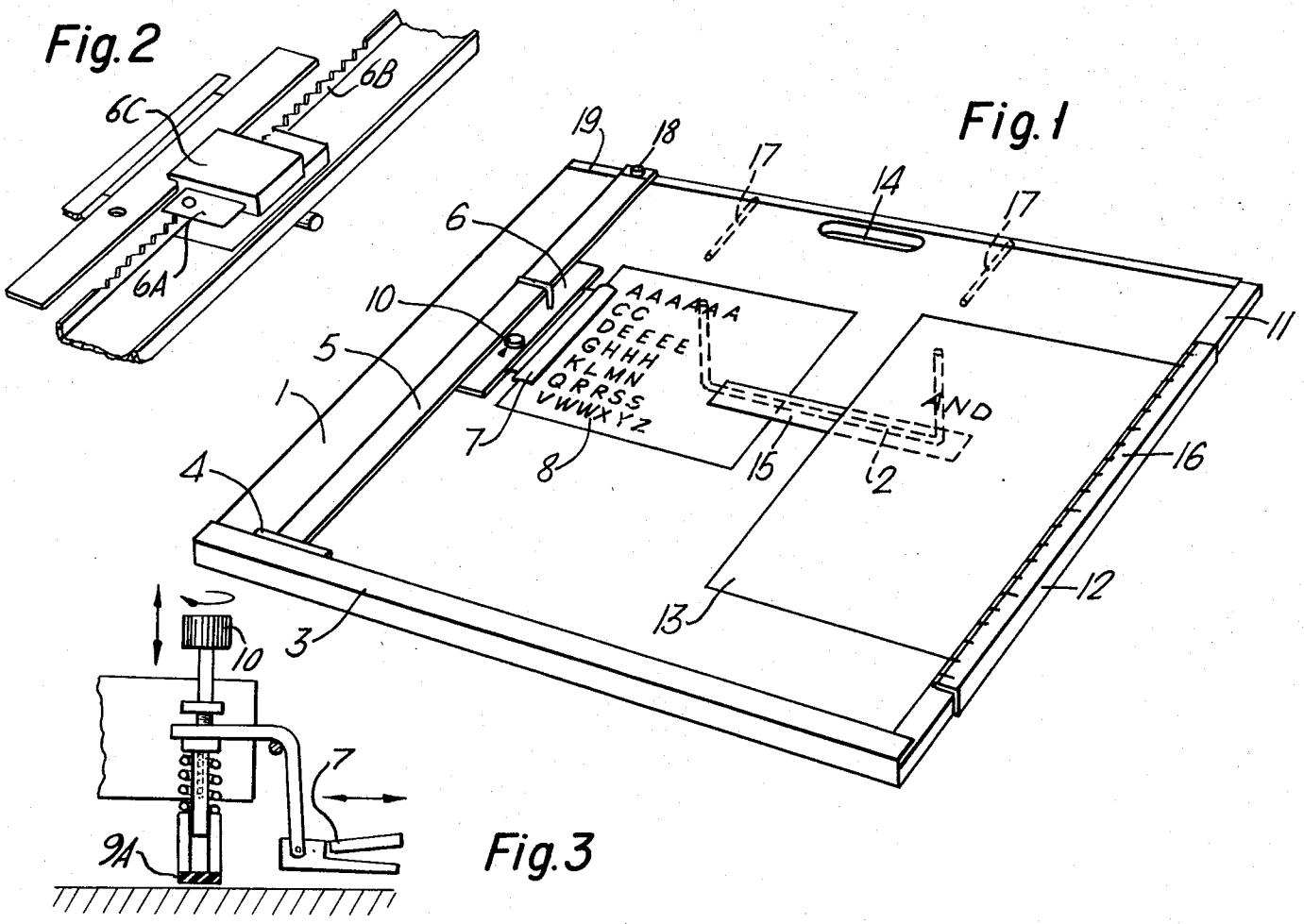

AND
AAAAA
CC
DEEEE
GHHI
KLMN
QRRSS
VWWXYZ

LAYOUT BOARDS

FIELD OF THE INVENTION

This invention relates to layout boards, particularly for use with dry transfer materials.

BACKGROUND TO THE INVENTION

In recent years dry transfer materials, particularly dry transfer lettering sheets, have come into widespread use for applying lettering to artwork so that it looks as though it has been printed there. A major problem in connection with the use of such material, however, is securing appropriate alignment and spaces of the individually transferred letters. The eye, on account of its high Vernier acuity, is very sensitive to misalignment and to uneven spacing.

Various proposals have been made to provide apparatus for use with dry transfer lettering sheets. Exemplary of the current state of the art are German Auslegeschrift No. 2345657, published European Patent Application No. 0005915 and British Specification Nos. 2007154A and 2013573A. The last three of these are typical in describing drawing boards of substantial size which are naturally expensive to purchase and consume space. The size and bulk of such equipment, and its cost, militates against the widespread use of such alignment devices and accordingly reduces the potential exploitation of the dry transfer materials.

OBJECTS OF THE INVENTION

It is a primary object of the present invention to design a layout board which is compact but nevertheless flexible and which can be used to give rapid and accurate alignment and which, when used with appropriate dry transfer sheets and optionally also with an appropriate receptor sheet, can be used even by relatively unskilled personnel to produce excellent results.

GENERAL DESCRIPTION OF THE INVENTION

According to a first feature of the present invention there is provided a layout board for use with a dry transfer sheet comprising a board having along one edge thereof a straight track, a first carriage mounted for sliding movement along the track and having an arm extending perpendicular to the track, and a second carriage mounted slidingly for movement along the arm, the second carriage having means dividing its movement into a plurality of equally spaced steps and means for supporting a dry transfer sheet extending laterally of the arm along an edge of the dry transfer sheet parallel with that arm, and clamp means extending parallel to the arm and along one edge of the base board adapted to clamp a receptor sheet at one edge, the sheet then extending across the board.

Such an arrangement enables a drawing board to be constructed with an economy of space rendering it suitable for occasional and office use. A convenient overall board size is substantially that of an A2 sheet of paper (42×59.4 cm), the track mounted along one edge of the board being mounted on one of the long edges of such a board.

The dry transfer sheet support means and the receptor sheet clamp are preferably magnetic clamps. In a particularly preferred embodiment, the transfer sheet support may be movable, e.g. using an actuation button, from a first position to a second position in a direction perpendicular to the extending arm, the distance between first and second positions being a distance corresponding to the desired letter spacing. Preferably means are provided to adjust that distance, e.g. from 0 to 3 mm, in accordance with the nature of the transfer sheet being used. The optimum distance will vary with the point size, of the lettering, the typeface and the type of spacing (close or wide) desired. When using such a preferred embodiment, appropriate letter spacing may be achieved in the following fashion: after a first letter has been laid down on the receptor, the next letter requiring to be transferred is selected and positioned to the right of the first letter by the user. By careful manoeuvring the two letters are brought to a position where they appear to abut, and the actuation button or the like is then depressed. This first of all brakes the horizontal motion, i.e. stops the movement of the first carriage relative to the track, and then moves the dry transfer sheet by the appropriate amount away from the previous letter and the next letter may then be rubbed down in the usual way. By repeating this procedure an evenly spaced word may be obtained with appropriate kerning.

The alignment of the letters along the word is achieved by using, in known fashion, the stepped spacing of the dry transfer sheet mounting member in conjunction with a dry transfer sheet in which the lines of letters thereon are spaced an integral multiple of the step distance. This can be achieved not only within the confines of using one sheet but also, if the transfer sheet support means and transfer sheet have cooperating means enabling the sheet to be located vertically (i.e. in the direction of the arm), from sheet to sheet, so accurate horizontal spacing can be achieved even if the user has to change from one dry transfer sheet to another half-way through a word, for instance if the supply of one type of letter runs out. The cooperating means can be visual, e.g. printed markings to be aligned on sheet and support, or mechanical, e.g. pins on the support and punched holes in the transfer sheet.

The upper surface of the board conveniently has a visible identification, e.g. a rectangle or other area of contrasting colour to the remainder of the board, and the face of the board may conveniently be provided with other rulings or markings to assist in alignment of a receptor sheet, and in defining a "target area" in which the actual dry transfer operations are conveniently carried out. This target area generally extends horizontally from about the centre of the board some distance to the right and vertically is approximate central and e.g. 3 cm in height. The use of a target area in this way enables the overall size of the apparatus to be kept easily handlable, at the same time as enhancing the ability to space and align legends from dry transfer material easily, accurately and quickly.

The receptor sheet clamp, conveniently along the right-hand vertical edge of the board, as viewed by the user, enables the receptor sheet, e.g. paper, Bristol board or drafting film, to be positioned where desired. The clamp is, as noted above, preferably magnetic and most preferably has a magnetic strip running along the edge of the board and a wholly detachable magnetic clamping piece which can be moved longitudinally relative to the strip. This allows considerable flexibility of positioning. The clamping piece can bear markings allowing the sheet to be centred relative thereto, which markings remain visible during use of the board and assist in laying out. A double scale with a centre zero is a preferred scale.

The edge of the board remote from the rail may be provided with a carrying handle. The board may additionally be provided with a member which can be stowed flat in the board when the board is not being used and which may be mounted in the underside of the board at a position remote from the rail in order to give the board, when laid on a desk, an inclined position.

If desired, the layout board may be foldable or dismantlable for ease of storage. One convenient approach for landscape format boards is to have the base board divided horizontally into two halves and the arm pivotable on the first carriage so that it can be disengaged from a working position, in which it extends perpendicular to the track, and folded to a storage position in which it lies substantially parallel to the track. In such position the upper half of the board may fold down to bring the board top edge adjacent the track, with the carriages and arm between the two board halves.

A problem in the use of dry transfer materials as media for applying legends to artwork, drawings and the like is that of positioning the whole legend where desired. It is, of course, very difficult to judge just how long a word will be before one has transferred all the letters and thus, for example, it is very difficult to know where to start a word in a given space if the entire wording needs to appear optically central within that space.

In these circumstances, the device of the present invention may be used with receptors other than the place where it is desired to have the final legend. For example, one convenient form of receptor consists of a sheet of release paper to which are adhered a number of strips of adhesive tape. A portion of the end of each strip may be adhered to an intermediate member enabling the strip of paper to be peeled easily from the release paper surface. Such a sheet is used as a receptor and words may be transferred on to tape from dry transfer material, whereafter the strip of tape may be peeled from the release paper, positioned where desired and stuck down. The tape may be of such a quality that, when the artwork is subsequently photographed, the tape and its edges do not appear on the photographed result.

Alternatively, the desired word may be assembled on one or more pieces of appropriate material, e.g. filter paper, using the layout board of the present invention and those sheets thereafter used to transfer the legend on to an intermediate transfer tape, the filter paper removed and the letters then applied from the intermediate transfer tape on to the desired final substrate. In both of these cases, the strips of adhesive tape or filter paper may be provided in an appropriate cassette which, e.g. may be set in the base of the layout board of the invention. Such a cassette may be associated with means acting to treat the receptor material as it is removed from the cassette, e.g. by stripping a backing therefrom or applying treatment liquid thereto, e.g. water. Other dry-working lettering tape systems may be analogously employed.

If desired, a section of the base board in the "target area" may be removable as a unit and exchangeable for other such units, e.g. ones having circular centring markings, or ones adapted for use with solid articles on to which it is desired to apply lettering and provided with means for holding the article with the surface needing to be decorated coplanar with the upper surface of the baseboard.

SPECIFIC DESCRIPTION OF THE DRAWINGS

The invention is illustrated by way of example with reference to the accompanying drawing wherein:

FIG. 1 is a perspective view of a layout board according to the present invention; and FIGS. 2 and 3 are detailed views in perspective and elevation, respectively, of portions of FIG. 1.

Referring to the drawing a base 1 rests on its lower edge and on a C-shaped support 2 the ends of which fit into blind holes in the rear face of base 1. It is accordingly supported at an appropriate angle, e.g. 5 to 10 degrees when laid on a horizontal desk. For flat storage, support 2 may be removed from the blind holes in the rear face of base 1 and fitted into a pair of deep blind holes 17 in the upper edge of the board.

Along the lower edge is a track 3 in which is slidingly mounted a carriage 4 from which extends an arm 5; the top end of arm 5 runs by means of a support wheel 18 in a track 19 along the top edge of the base 1. A further sliding carriage 6 slides up and down arm 5. Carriage 4 runs smoothly in track 3 and may be moved smoothly along it to any position. Carriage 6, however, although slidable smoothly along track 5 is provided with a ball catch **6*a* which engages with a number of spaced slots in track 5 so as to register the position of carriage 6 with a plurality of evenly spaced positions corresponding to the sheet line spacing, i.e. the interline spacing on the sheet is an integral multiple of the evenly spaced step distance. Means 6*C* is provided for grasping in order to move the carriage 6 in a direction perpendicular to the track 3. On carriage 6 is a magnetic clamp 7, shown holding a dry transfer sheet 8. Magnetic clamp 7 may have register pins or the like adapted to register with perforations or markings on transfer sheet 8 in order to ensure that when the transfer sheet is installed as shown the lines of letters are parallel to track 3**.

A dial 10 is provided on carriage 6. When the dial 10 is depressed, it applies a brake stopping member 5 sliding horizontally, and additionally moves clamp 7 away from carriage 6 by a small amount. The amount of movement may be preset, by rotation of the dial 10, to between 0 and 3 mm. As the dial 10 is rotated, it adjusts the vertical position of the brake when the brake is not applied. This determines the vertical stroke of the brake when the brake is applied and therefore how far to the right (FIG. 3) the clamp 7 advances.

In accordance with the invention, set along the right-hand edge of the board is a magnetic strip 11 which cooperates with a similar magnetic strip set inside angled bar 12, strips 11 and bar 12 thus constituting a clamp enabling a sheet of paper 13 to be held by its right hand vertical margin, as shown. The sheet may be positioned vertically as desired. A scale may be present on surface 16 of bar 12 to assist correct layout, and this bar may also be moved vertically to a selected position.

The board is provided with a cut-out 14 to enable it to be carried easily. A centre mark 15 in the form of a rectangle of contrasting colour is provided; this assists in defining a "target" or working area in which the user does the transferring, and the provision of such a target area materially assists the user in effecting speedy and efficient sequential transfer of selected indicia, each properly aligned with the preceding ones.

In use the desired receptor is clamped to the right-hand edge of the board as shown and an appropriate dry transfer sheet 8 inserted into a magnetic clamp 7. The member 5 and carriage 4 are then slid across to the appropriate position and carriage 6 moved up and down until the appropriate first letter is positioned over the receptor. This is then transferred, e.g. by rubbing over the letter with a stylus in the usual way and the next letter then selected. If the letter is on a different row of letters on the transfer sheet 8, carriage 6 is racked up and down appropriately. The second letter is moved laterally by sliding carriage 4 and bar 5 until it just appears to touch the first letter. The dial 10 is then depressed which clamps carriage 4 and bar 5 and moves clamp 7 to the right, e.g. by 2 mm. The letter is then transferred and the process repeated until the complete word is made up.

If one runs out of letters on one sheet, then provided matching sheets are used, it is easy to remove the old sheet and replace it with a new while maintaining the alignment.

We claim:

1. A layout board for use with a dry transfer sheet comprising a rectangular board having an upper support surface, a straight track along one edge of the board, a first carriage mounted for sliding movement along said track, an arm on said first carriage extending perpendicular to said track and across said upper support surface, a second carriage mounted slidingly for movement along said arm, means dividing the movement of the second carriage along said arm into a plurality of equally spaced steps, and means mounted on said second carriage for supporting a rectangular dry transfer sheet, said dry transfer sheet extending in a first direction laterally of the arm and having transferable indicia thereon, the support means engaging an edge of the dry transfer sheet parallel with said arm, said first direction being parallel with said track, magnetic clamp means extending parallel to the arm and along one edge of the base board, said magnetic clamp means comprising a fixed strip and an angled bar movable with respect thereto in a direction perpendicular to said track, and said strip and bar being releasably held together by magnetic attraction and adapted to clamp a receptor sheet at one edge, the sheet then extending across the board in a second direction opposite said first direction, and an elongate target area of contrasting color located on said upper support surface, parallel to said track and extending from a position substantially at the center of said upper support surface towards said clamp means, whereby indicia can be transferred from said dry transfer sheet onto said receptor sheet in said target area.

2. The layout board of claim 1 and having overall size substantially that of an A2 sheet of paper, with the track mounted along one long edge of the board.

3. The layout board of claim 1 wherein the dry transfer sheet support means is a magnetic clamp.

4. The layout board of claim 1 wherein the transfer sheet support is movable, from a first position to a second position in a direction perpendicular to the extending arm, the distance between first and second positions being a distance corresponding to a desired letter spacing.

5. The layout board of claim 4 and including means to adjust the distance between first and second positions.

6. The layout board of claim 4 and including means which when actuated first barkes the horizontal lateral motion of the first carriage relative to the track, and then moves the dry transfer sheet support.

7. The layout board of claim 1 and provided with a member which can be stowed flat in the board when the board is not being used and which may be mounted in the underside of the board at a position remote from the rail in order to give the upper face of the base board, when the board is placed on a horizontal surface, an inclined position.

* * * * *